United States Patent [19]

Brunet

[11] 4,413,755

[45] Nov. 8, 1983

[54] METERED AEROSOL VALVE FOR USE IN INVERTED POSITION

[75] Inventor: Michel Brunet, Sainte Colombe La Commanderie, France

[73] Assignee: Etablissements Valois, Le Neubourg, France

[21] Appl. No.: 363,748

[22] Filed: Mar. 30, 1982

[30] Foreign Application Priority Data

Mar. 30, 1981 [FR] France ..... 81 06272

[51] Int. Cl.[3] ..... B65D 83/00

[52] U.S. Cl. ..... 222/402.2; 222/402.24; 251/354

[58] Field of Search ..... 222/145, 402.1, 402.12, 222/402.19, 402.2, 402.24, 476; 251/322, 323, 354

[56] References Cited

U.S. PATENT DOCUMENTS

| | | | |
|---|---|---|---|
| 3,394,851 | 7/1968 | Gorman | 222/402.2 |
| 3,447,551 | 6/1969 | Braun | 251/354 X |
| 3,511,418 | 5/1970 | Venus, Jr. | 222/402.2 |
| 3,521,859 | 7/1970 | Gronemeyer | 251/353 |
| 3,591,059 | 7/1971 | Stearns | 222/402.2 |

FOREIGN PATENT DOCUMENTS

| | | | |
|---|---|---|---|
| 1292114 | 3/1962 | France | 222/402.2 |
| 864694 | 4/1961 | United Kingdom | 222/402.2 |

*Primary Examiner*—Joseph J. Rolla
*Assistant Examiner*—Michael S. Huppert
*Attorney, Agent, or Firm*—Sughrue, Mion, Zinn, Macpeak and Seas

[57] ABSTRACT

Part (14) of stem (4) which extends through opening (31) of lower basket (12) is provided with ribs (17) for having an easier passage of material, either during initial filling or during normal use. The lower part of valve body (1) is provided with openings (19), the number of which is different from the number of ribs (17).

5 Claims, 2 Drawing Figures

6
5
4
11
32
7
9
25
3
13
29
2
26
23
31
24
12
1
25
II
II
14
15
33
16
19
30
8
20
21

19
20
17a
17d
I
I
17b
17c

METERED AEROSOL VALVE FOR USE IN INVERTED POSITION

This invention relates in general to a metered aerosol valve construction, for being mounted on the opening of a pressurized container, to be filled with a liquid material with a miscible gas under pressure for controlling the discharge of a metered amount of material from said container when it is in inverted position. A valve of this type can be found in the prior art especially in FR P 1,287,373 to Lucien Guillou. The valve described in this patent is to be used in upright position, with the container opening upwards.

The present invention has more particularly for its object a valve of the type above mentioned, for use in inverted position and allowing to properly discharge controlled quantities, without alteration of the discharged amount until the container is empty, and to allow the filling of the container in better conditions. Valves provided for being used with the container in inverted position are described for example in U.S. Pat. No. 3,394,851 to Gorman and FR P 2,403,833 to Glaxo. The device of the U.S. Patent is adapted for use with compressed gas, i.e. gases which are not mixed with the material to be expelled, as distinct from present invention which is for expelling materials with which the gas is miscible. In this U.S. patent, the valve return spring is disposed in the outwards upper portion of the valve body, what increases the path of the material to be expelled, and causes an increase of size for the valve, so restricting its applications. In the valve of the FR P, the valve return spring is located at the bottom of the valve. In this case, the filling of the metering chamber by the product to be expelled may be hindered.

The present invention contemplates a valve of the above type in which the valve return spring is disposed in the bottom of the valve, but in which a complete filling of the metering chamber is ensured during the whole service of the aerosol container.

Various other objects, features and attendant advantages of the present invention will be more fully appreciated as the same becomes better understood from the following detailed description of the present invention when considered in connection with the accompanied drawings.

Figure 1:
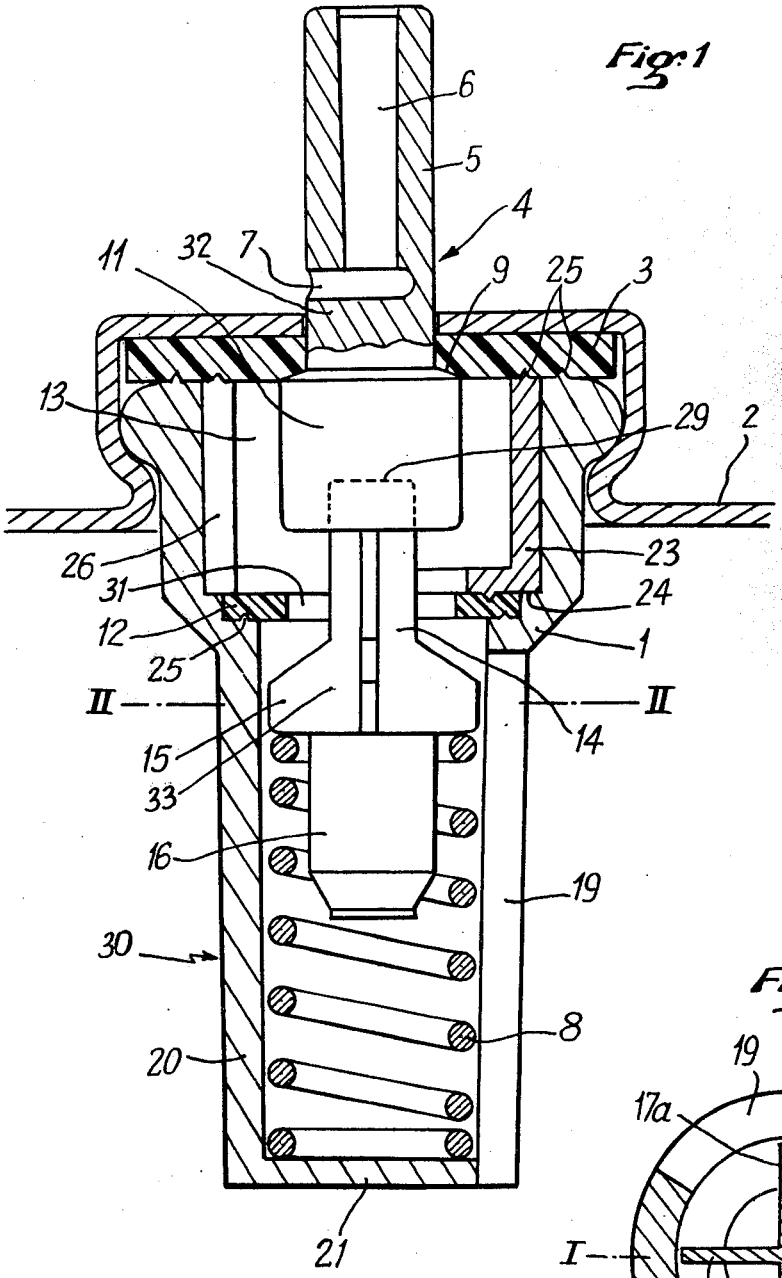
Figure 2:
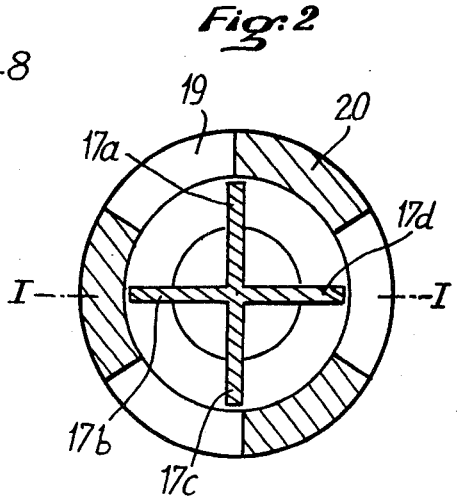

FIG. 1 is an axial section of a valve, either side being a different embodiment of the invention; and FIG. 2 is a cross sectional view taken along line II—II of FIG. 1.

The valve according to the invention, provided for being fastened in the aperture of a container such as a bottle or similar, includes a valve body 1 sealed in a ferrule 2 with interposition of an annular gasket 3. Ferrule 2 is itself set on the neck of a container, not shown, with interposition of another gasket, in a well-known manner. Such a container is used for expelling a liquid material, with a miscible gas under pressure mixed with the material to be expelled. The operation principle of such a metering valve is well-known. It is described in above cited patents. The valve body is formed at its upper part with a metering chamber 13, and at its lower part with a housing 30 for a return spring. The words "upper" and "lower" are used for the container when the latter is in an upright position, with the opening upwards. It is provided that the container should be tilted and put in the inverted position, with its opening downwards for being used in expelling the material.

Inside valve body 1 is disposed a valve stem 4, a part 5 of which is extending outside the valve through gasket 3. This stem is formed with an inner axial or longitudinal canal 6 opening at the outer end of the stem, and in communication with a radial passage 7. Stem 4 is biased upwardly by a return spring 8 and comes in abutment on gasket 3 by means of a shoulder 9. In the stand-by position, with spring 8 unloaded, shoulder 9 is resting in abutment on gasket 3 and passage 7 opens above gasket 3 (possibly inside the gasket but not underneath) so that the container is tightly closed and the material inside cannot escape. Inside the metering chamber, stem 4 is formed with a bulge or piston 11, for example of the same diameter as shoulder 9, and an annular gasket 12 is disposed on the bottom of the metering chamber 13, the central opening 31 on said gasket 12 being of the same diameter as piston 11.

When the container is inverted, with the opening downwards and stem 4 is depressed against spring 8 strength by means of a push-button not shown, piston 11 thus closes opening 31 of gasket 12 before passage 7 appears on the lower face of gasket 3. There is so formed a closed space or chamber 13, which contains a metered amount of material, the volume of which is provided in a precise manner, and which contains propellant gas solved under pressure in the liquid material.

Upon further depressin of stem 4 against spring strength, the opening of passage 7 enters in chamber 13, underneath gasket 3, and the content of chamber 13 expands then escapes through passage 7 and canal 6, due to the pressure of the dissolved gas. After discharge of a metered amount, stem 4 is released and returns to its initial position owing to the strength of spring 8. Chamber 13 is then open. For having another amount of material in chamber 13, the container must be placed in the inverted position. The material enters chamber 13 by at least one opening provided in the lower part of the valve body, underneath gasket 12. Beyond bulge 11, stem 4 is advantageously formed with a slender part 14 provided with a shoulder 15 where spring 8 finds its upper abutment, the lower abutment being bottom part 21 of valve body 1. The end of stem 4 is formed with a shank 16 forming guide means for spring 8. The size of slender pat 14 is such that, when the stem is not depressed, i.e. is in resting position, and bulge 11 is out of opening 31 of gasket 12, the material can easily run in chamber 13.

According to the invention, the slender part 14 is formed with several radial ribs 17*a*, 17*b*, 17*c* and 17*d*, the section of which being regular or not, and extending from bulge 11 into shoulder 15. Advantageously, each rib has the form shown on FIG. 1. This disposition affords the advantage of providing an important section for the flowing material, during initial filling as well as during normal use. Ribs 17 further maintain the free passage through opening 31 of gasket 12, should the latter swell by action of the liquid material. In combination with this form of stem, the lower part of the valve body, forming a spring housing 30, is provided with longitudinal openings 19 extending along the whole length of spring housing 30, i.e. from a point adjacent to gasket 12, under this latter, and to the bottom of housing 30, the number of openings 19 being different from the number of ribs 17, so as to have always a continuous free passage, in a way to avoid having a rib in front of each opening 19.

In a preferred embodiment of the present invention, there is four ribs 17 and three openings 19, separated by walls 20 united by bottom 21.

According to another feature of the present invention, valve stem 4 is formed of two parts: a first upper part 32 comprising the outer stem 5 and the bulge 11, and a second lower part 33 comprising the slender part 14, shoulder 15 and shank 16. These two parts are easier to manufacture, with more precision, avoiding the costly shell moulding. Said two parts may be united by every suitable means such as force nested, with or without adhesive, (as shown by dotted line 29), screwed, soldered or else.

So as to keep gasket 12 in position, it is possible to provide a peripheral insert 23 (on the right half of FIG. 1), having abutment on one side against gasket 3 and on the other side against a shoulder 24 formed in valve body 1, what limits the tightening of gasket 12.

To avoid pssible sliding of gaskets 3 or 12, points 25 are provided on valve body 1 and/or on insert 23.

Instead of an insert, valve body 1 may be formed with radial ribs 26 (on the left half of FIG. 1) which maintain gasket 12 and further stiffen chamber 13, in cases of important discharges when said chamber is large and its wall thinner. By avoiding deformations of the chamber, said ribs 26 allow to have more precise metered amounts.

Having thus described the invention and the advantages thereof, it must not be limited to the details herein disclosed, otherwise than as set forth in the following claims.

What is claimed is:

1. A valve for being mounted in the opening of a pressurized container, for being filled up with a liquid material to be atomized, containing a propellant miscible gas solved under pressure in said liquid material, and for expelling precise metered amounts of material when the container is maintained in inverted position with the opening downwards, comprising a valve body (1) of tubulr form, said body forming at its upper part, when the container is in upright resting non inverted position, a metering chamber (13) adjacent to the container opening, limited by a generally cylindrical wall (23,26), two radial walls formed by a first upper annular gasket (3) with a central opening and a second lower annular gasket (12) with a central opening (31), and a valve stem (4) extending through gasket openings and including an upper extension (5) extending out of the valve, said stem comprising between gasket (3) and gasket (12) a bulge (11) provided for closing opening (31) by downward movements, said stem (4) extending downwards by comprising a slender part (14) passing through opening (31) when the valve is at rest, and a guiding shank (16), the upper outer part (5) of stem (4) comprising an axial canal (6) externally communicating through a passage (7) located outside of the valve when said valve is at rest and inside of the valve when the stem is displaced downwardly, said valve body forming at its lower part a tubular housing (30) with a bottom (21) for receiving a return spring finding its upper abutment against a shoulder (15) of the stem and its lower abutment against bottom (21), wherein the slender part (14) of stem (4) is formed with ribs (17), and housing (30) is formed with a longitudinal opening (19), the number of openings (19) being different from the number of ribs (17).

2. A valve as in claim 1, which comprises four ribs (17*a*, 17*b*, 17*c*, 17*d*) and three openings (19).

3. A valve as in claim 1 or claim 2, wherein valve body (1) is formed with radial ribs inside the metering chamber between the upper and lower gaskets.

4. A valve as in any one of claims 1 or 2, wherein a peripheral insert (23) is disposed in the metering chamber, between the upper and lower gaskets.

5. A valve as in ay one of claims 1 or 2, wherein the valve stem (4) is formed of two gathered parts, an upper part (32) comprising the outer extension (5) and the bulge (11), and a lower part (33) comprising the slender part (14), the shoulder (15) and the shank (16).

* * * * *